US006983808B1

(12) United States Patent
Chen

(10) Patent No.: US 6,983,808 B1
(45) Date of Patent: Jan. 10, 2006

(54) POWER TOOL WITH OIL CIRCULATION APPARATUS

(76) Inventor: Ting-Yuan Chen, No. 230, Jian Shin Road, Taya Hsiang, Taichung Hsien (TW)

( * ) Notice: Subject to any disclaimer, the term of this patent is extended or adjusted under 35 U.S.C. 154(b) by 0 days.

(21) Appl. No.: 10/987,535

(22) Filed: Nov. 12, 2004

(51) Int. Cl.
*B25D 15/00* (2006.01)

(52) U.S. Cl. ..... 173/93.5; 173/93

(58) Field of Classification Search ..... 173/93, 173/93.5, 93.6, 213, 218, 205, 104
See application file for complete search history.

(56) References Cited

U.S. PATENT DOCUMENTS 3,174,597 A * 3/1965 Schaedler ..... 173/93.6
3,414,065 A * 12/1968 Falter ..... 173/93.5
3,533,479 A * 10/1970 Albertson ..... 173/93.5
3,578,091 A * 5/1971 States ..... 173/176
4,313,505 A * 2/1982 Silvern ..... 173/93.5
5,622,230 A * 4/1997 Giardino et al. ..... 173/93.5
6,135,212 A * 10/2000 Georgiou ..... 173/48
6,446,735 B1 * 9/2002 Chen ..... 173/93.5
6,464,017 B1 * 10/2002 Chen ..... 173/93.5
6,796,386 B2 * 9/2004 Izumisawa et al. ..... 173/93.5

* cited by examiner

*Primary Examiner*—Scott A. Smith
(74) *Attorney, Agent, or Firm*—Alan D. Kamrath; Nikolai & Mersereau, P.A.

(57) ABSTRACT

A power tool includes a sleeve, two pistons, a converter and a striker. The sleeve includes an axial aperture defined therein, a space communicated with the axial aperture, two grooves defined in the wall of the space and peripheral apertures communicated with the space. Oil flows into and from the space through the peripheral apertures. The pistons are put in the grooves. The converter is provided between the sleeve and the pistons for converting the rotation of the sleeve into rectilinear movement of the pistons. The striker is driven by the pistons.

10 Claims, 7 Drawing Sheets

POWER TOOL WITH OIL CIRCULATION APPARATUS

BACKGROUND OF INVENTION

1. Field of Invention

The present invention relates to a power tool with an oil circulation apparatus.

2. Related Prior Art

Referring to FIG. 7, a conventional power tool 110 includes a sleeve 120, a bearing 128, a ball 127, a converter 130, two pistons 150, a retaining ring 140, a striker 160 and a spring 170. The sleeve 120 includes an aperture 121, a small space 123 communicated with the aperture 121 and a large space 125 communicated with the small space 123. A recess 126 is defined in the wall of the small space 123. Two grooves 122 are defined in the wall of the large space 125. The bearing 128 is put in the small space 123. The ball 127 is put in the recess 126. The ball 127 slides on the bearing 128. The converter 130 is an annular element and includes an annular cam 134 formed with an inclined edge, an annular rib 133 formed on the annular cam 134 and teeth 135 formed on an internal face. Each piston 150 includes an annular groove 152 for receiving the annular rib 133. The converter 130 is put in the large space 125 so that the pistons 150 are put in the grooves 122. The annular retainer 140 includes two recesses 142 defined in the periphery thereof. The annular retainer 140 is put in the large space 125 so that the recesses 142 receive the pistons 150. The spring 170 is put in the large space 125 and inserted through the annular retainer 140. The striker 160 includes teeth 162 formed on a first section, two tabs 164 formed on a second section next to the first section and a square insert 165 formed on a third section next to the second section. The teeth 162 are engaged with the teeth 135. The spring 170 is compressed between the tabs 164 and the annular rib 133. In operation, the sleeve 120 is rotated. The ball 127 is rotated together with the sleeve 120. The inclined edge of the annular cam 134 is pushed by the ball 127. Thus, the rotation of the ball 127 is converted to rectilinear movement of the annular cam 134. The pistons 150 are moved by the annular rib 133. The tabs 164 are pushed by the pistons 150. Thus, the striker 160 is moved. Lubrication for reducing the friction between the elements is important. To this end, oil is filled in the sleeve 120. However, oil is expelled from the sleeve 120 easily when the pistons 150 and the tabs 164 are moved towards the exterior of the sleeve 120. The friction between the elements thus rises so that the elements wear out one another.

The present invention is therefore intended to obviate or at least alleviate the problems encountered in the prior art.

SUMMARY OF INVENTION

According to the present invention, a power tool includes a sleeve, two pistons, a converter and a striker. The sleeve includes an axial aperture defined therein, a space communicated with the axial aperture, two grooves defined in the wall of the space and peripheral apertures communicated with the space. Oil flows into and from the space through the peripheral apertures. The pistons are put in the grooves. The converter is provided between the sleeve and the pistons for converting the rotation of the sleeve into rectilinear movement of the pistons. The striker is driven by the pistons.

The primary advantage of the power tool of the present invention is that it provides adequate lubrication.

Other objects, advantages and novel features of the invention will become more apparent from the following detailed description in conjunction with the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
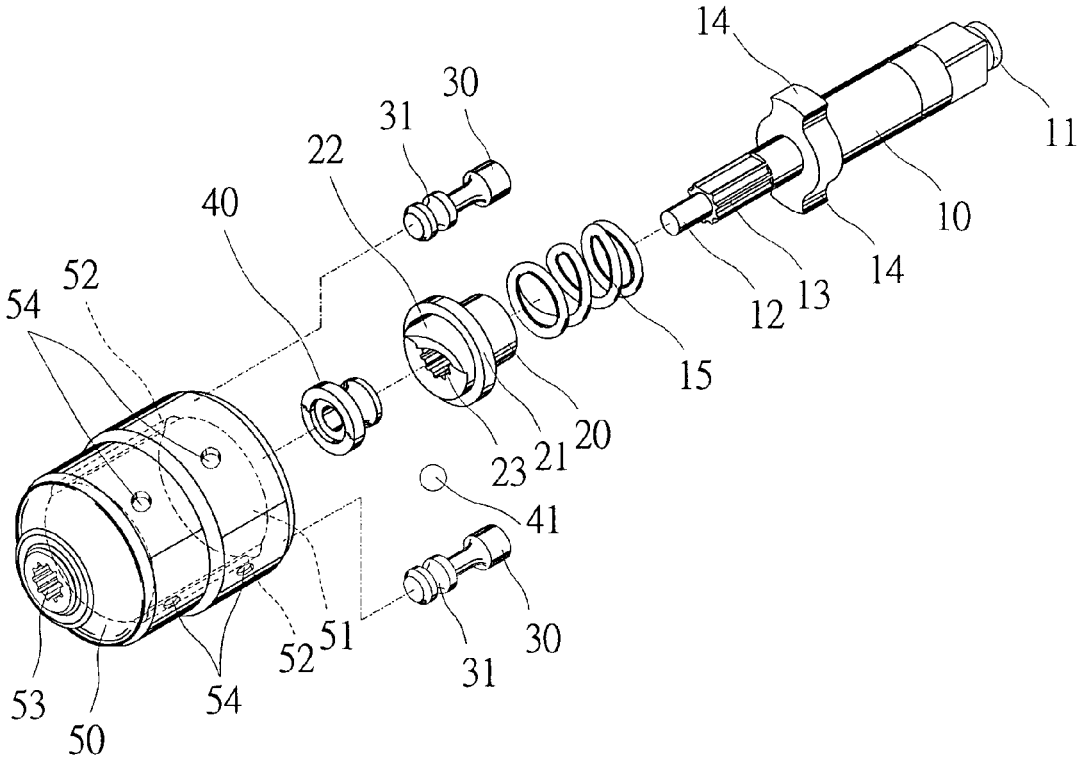
FIG. 1 is an exploded view of a power tool with an oil circulation apparatus according to the preferred embodiment of the present invention.
Figure 2:
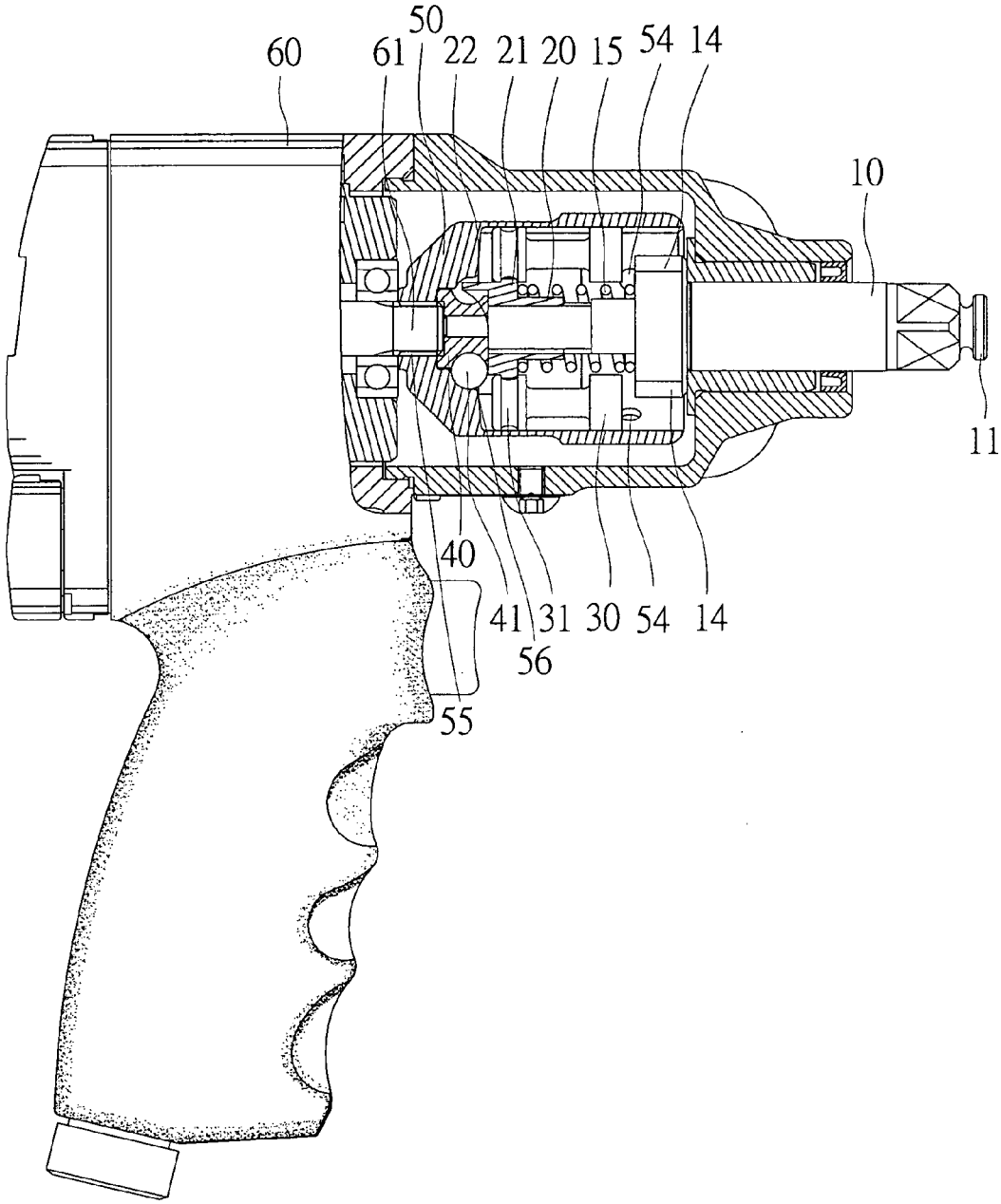
FIG. 2 is a front view, partially in cross-section, of the power tool with the oil circulation apparatus shown in FIG. 1.
Figure 3:
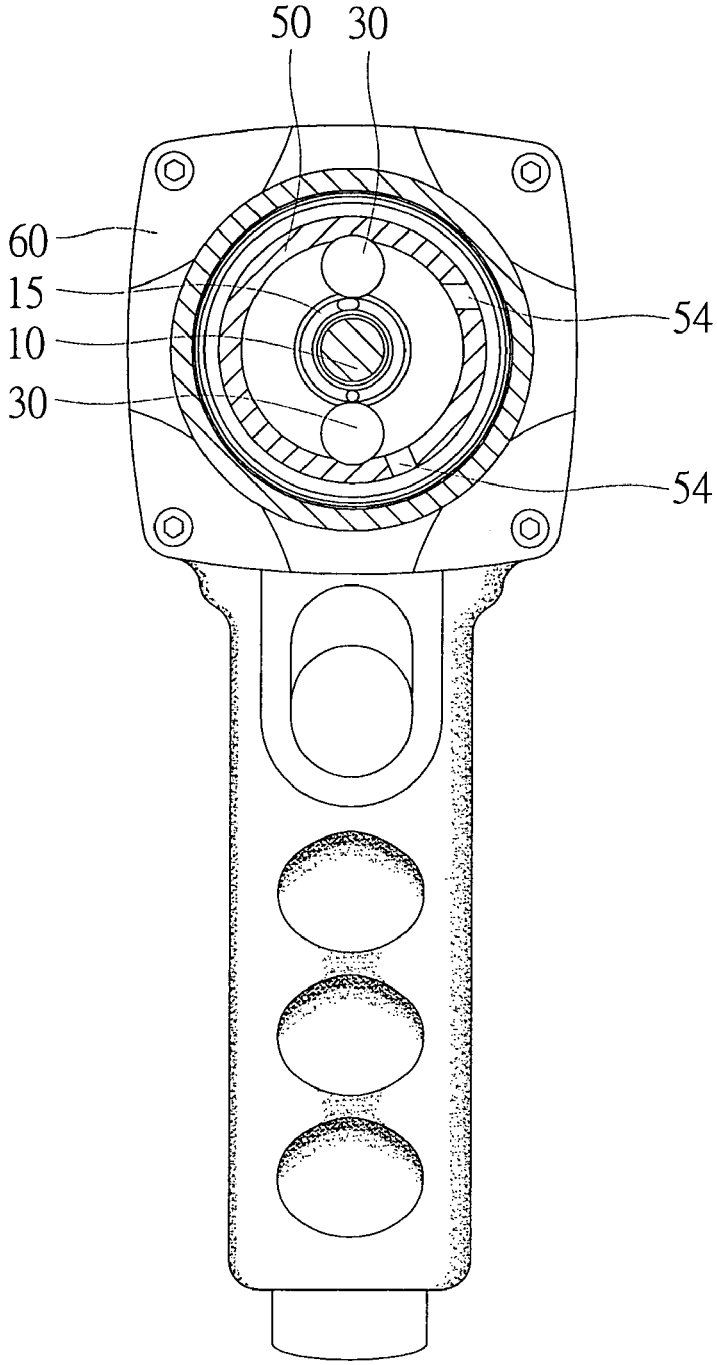
FIG. 3 is an end elevational view, partially in cross section, of the power tool with the oil circulation apparatus shown in FIG. 1.

Referring to FIGS. 1 through 3, according to the preferred embodiment of the present invention, a pneumatic tool 60 includes an axle 61, a sleeve 50, a bearing 40, a ball 41, a converter 20, two pistons 30, a striker 10 and a spring 15.

The sleeve 50 includes an aperture 55 and a space 51 communicated with the aperture 55. Teeth 53 are formed on the wall of the aperture 55. A recess 56 is defined in the wall of the space 51. Two grooves 52 are defined in the wall of the space 51. Four apertures 54 are defined in the sleeve 50.

The bearing 40 is put in the space 51. The ball 41 is put in the recess 56. The ball 41 slides on the bearing 40.

The converter 20 is an annular element and includes an annular cam 22 formed with an inclined edge, an annular rib 21 formed on the annular cam 22 and teeth 23 formed on an internal face. Each piston 30 includes an annular groove 31 for receiving the annular rib 21. The converter 20 is put in the space 51 so that the pistons 30 are put in the grooves 52.

Two of the apertures 54 are located near an end of the movement of the pistons 30 and the other apertures 54 are located near another end of the movement of the pistons 30.

The spring 15 is put in the space 51. The striker 10 includes teeth 13 formed on a first section, two tabs 14 formed on a second section next to the first section and a square insert 11 formed on a third section next to the second section. The teeth 13 are engaged with the teeth 23. The spring 15 is compressed between the tabs 14 and the annular rib 21.

In operation, the sleeve 50 is rotated. The ball 41 is rotated together with the sleeve 50. The inclined edge of the annular cam 22 is pushed by the ball 41. Thus, the rotation of the ball 41 is converted to rectilinear movement of the annular cam 22. The pistons 30 are moved by the annular rib 21. The tabs 14 are pushed by the pistons 30. Thus, the striker 10 is moved.

Referring to FIG. 3, some of the apertures 54 extend along radiuses of the sleeve 50, some do not. When an aperture 54 does not extend along a radius of the sleeve 50, it is angled from the radius so that when the pistons 30 are rotated in the space 51 oil can be drawn into the space 51 through the aperture 54.

Figure 4:
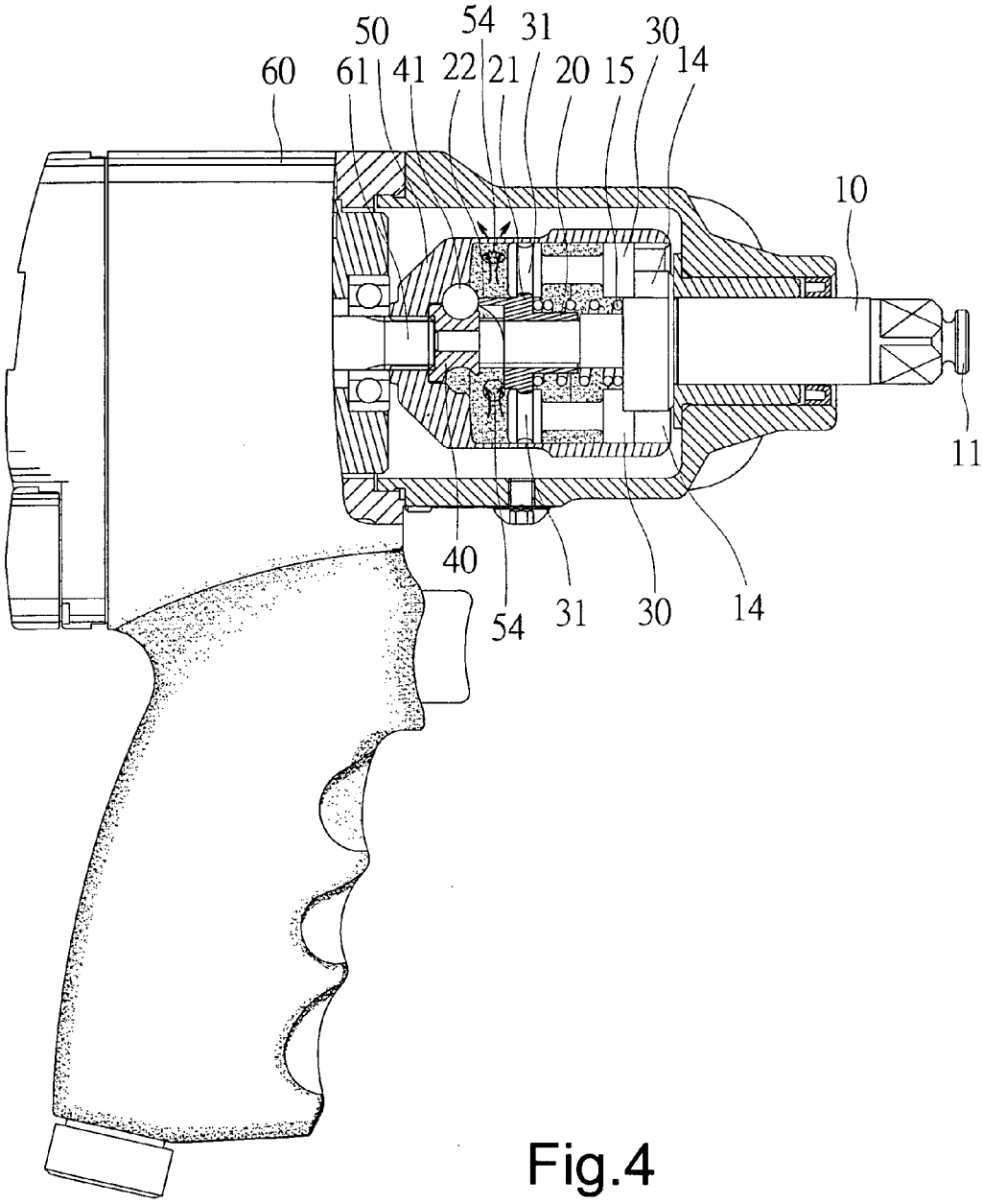
FIG. 4 is similar to FIG. 2 but shows the oil circulation apparatus filled with oil.

Referring to FIG. 4, when the sleeve 50 is rotated by the axle 61, a centrifugal force causes a portion of the oil to flow from the space 51 through the apertures 54 that extend along radiuses of the sleeve 50.

Figure 5:
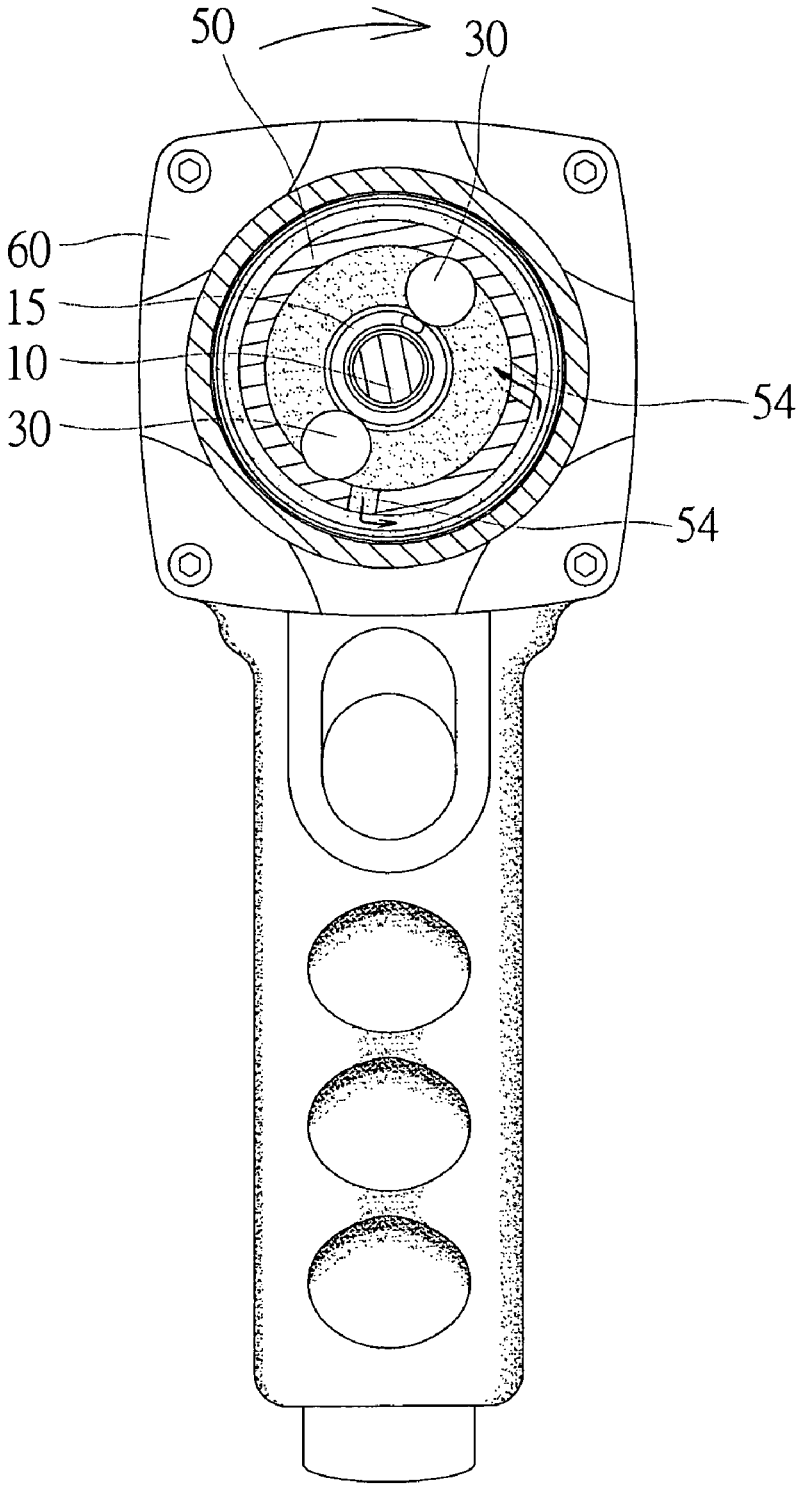
FIG. 5 is similar to FIG. 3 but shows the oil circulation apparatus filled with oil.

Referring to FIG. 5, a portion of the oil flows into the space 51 through the apertures 54 that do not extend along radiuses of the sleeve 50. Thus, adequate oil is retained in the space 51 in order to lubricate the elements.

Figure 6:
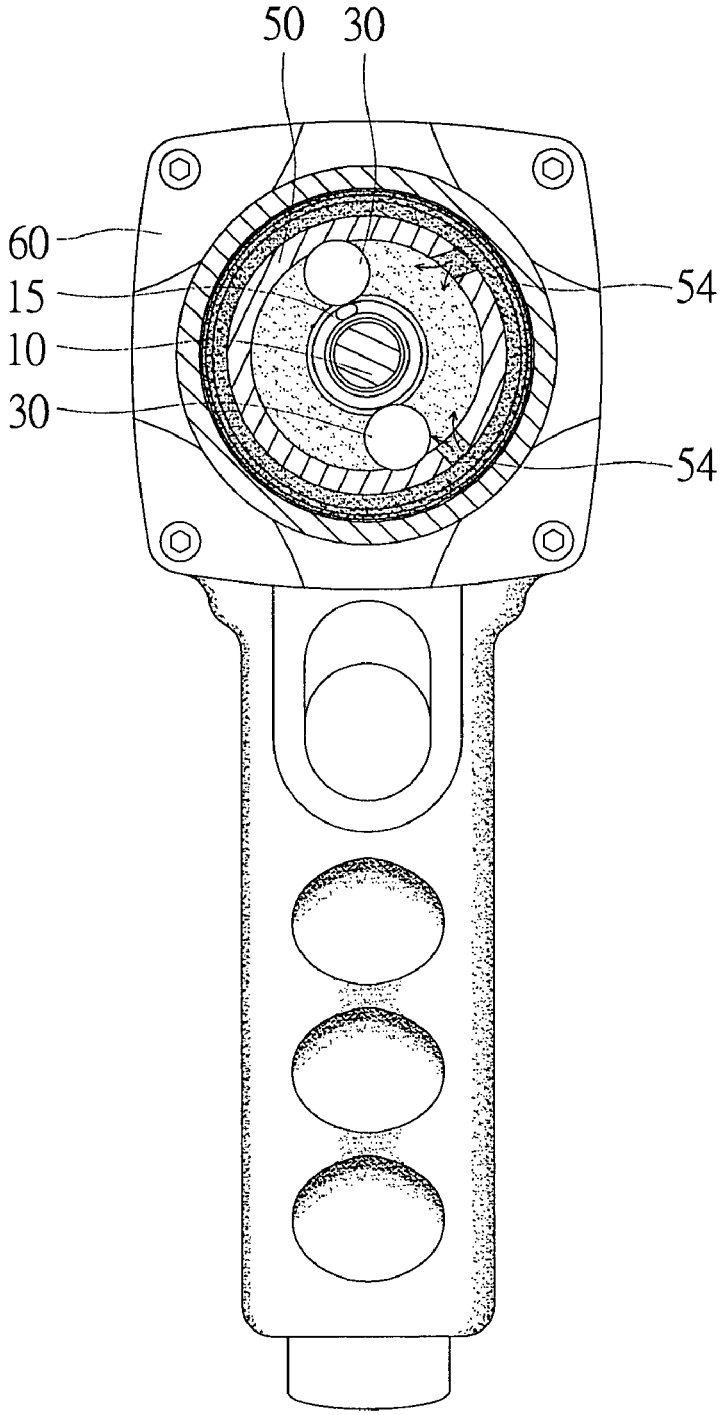
FIG. 6 is similar to FIG. 5 but shows the oil circulation apparatus in a different position.
Figure 7:
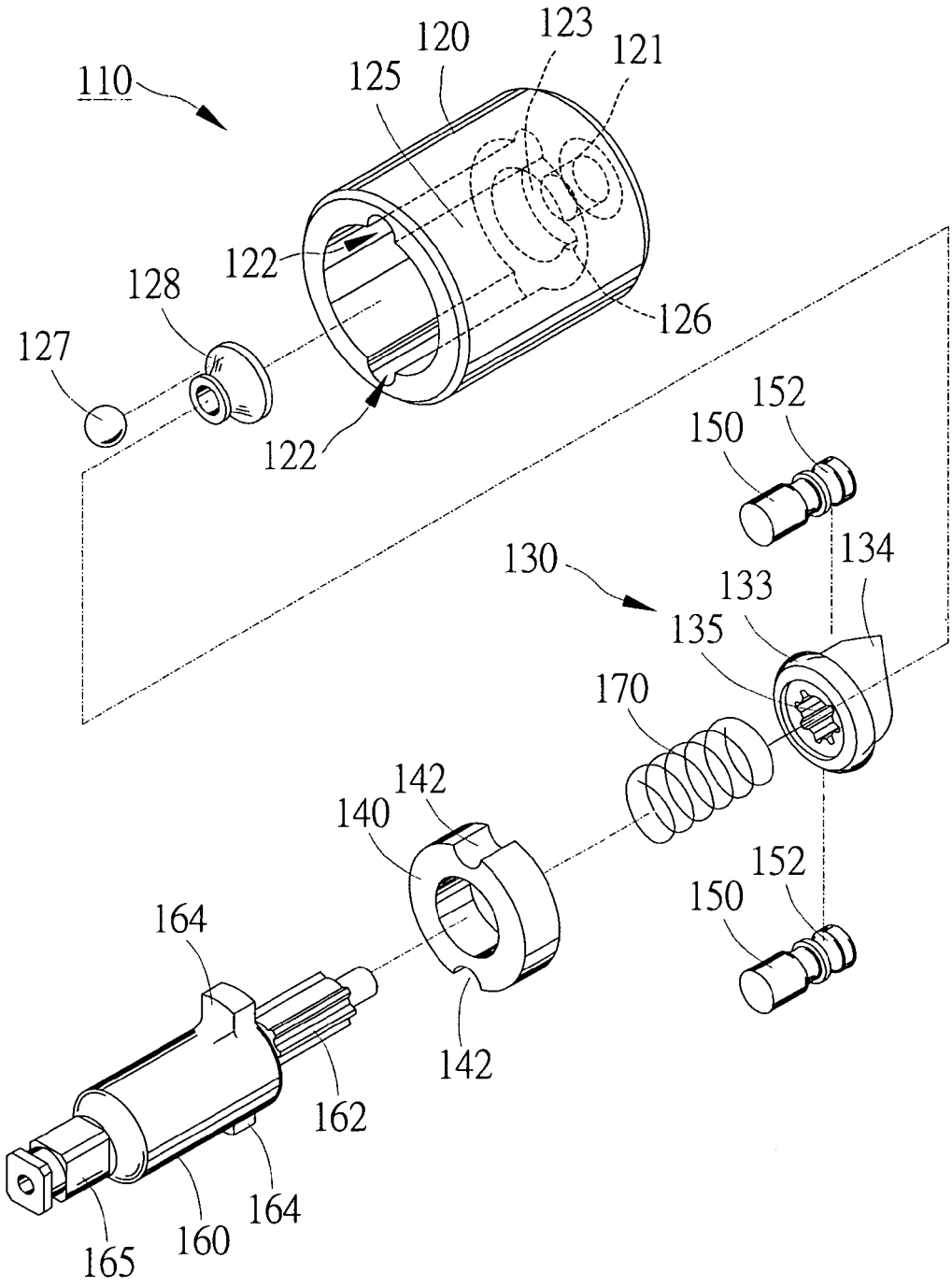
Fig.7 PRIOR ART
FIG. 7 is an exploded view of a conventional power tool.

Referring to FIG. 6, when the rotation of the sleeve 50 is terminated, the centrifugal is gone. Thus, a portion of oil flows quickly into the space 51 through the apertures 54 that extend along radiuses of the sleeve 50. A portion of oil flows slowly into the space 51 through the apertures 54 that do not extend along radiuses of the sleeve 50. Again, the space 51 is filled with the oil. The sleeve 50 can be used in an electrical tool as well as in the pneumatic tool 60.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A power tool comprising:

a sleeve comprising an axial aperture defined therein, a space communicated with the axial aperture and defined by a wall, two grooves defined in the wall of the space and peripheral apertures communicated with the space, wherein oil flows into and from the space through the peripheral apertures;

two pistons in the grooves;

a converter between the sleeve and the pistons for converting the rotation of the sleeve into rectilinear movement of the pistons; and a striker driven by the pistons.

2. The power tool according to claim 1 comprising a ball attached to the sleeve so that the ball is in rotation together with the sleeve.

3. The power tool according to claim 2 wherein the sleeve comprises, in the wall of the space, a recess in order to receive the ball.

4. The power tool according to claim 3 comprising a bearing in contact with the ball in the space.

5. The power tool according to claim 1 wherein some of the peripheral apertures are located in the sleeve near an end of the rectilinear movement of the pistons and the other peripheral apertures are located in the sleeve near an opposite end of the rectilinear movement of the pistons.

6. The power tool according to claim 1 wherein some of the peripheral apertures extend along radiuses of the sleeve.

7. The power tool according to claim 1 wherein some of the peripheral apertures do not extend along radiuses of the sleeve.

8. The power tool according to claim 7 wherein the some of the peripheral apertures are angled from the radiuses so that oil can be drawn into the space through the axial aperture when the pistons are rotated in the space.

9. The power tool according to claim 1 wherein some of the peripheral apertures extend along radiuses of the sleeve and other of the peripheral apertures do not extend along radiuses of the sleeve.

10. The power tool according to claim 9 wherein the other of the peripheral apertures that do not extend along radiuses of the sleeve are angled from the radiuses so that oil can be drawn into the space through the apertures when the pistons are rotated in the space.

* * * * *